US009403061B2

(12) United States Patent
Chiang

(10) Patent No.: US 9,403,061 B2
(45) Date of Patent: Aug. 2, 2016

(54) SWIMMING GOGGLES

(75) Inventor: Herman Chiang, New Taipei (TW)

(73) Assignee: GLOBAL ESPRIT INC., New Taipei (TW)

( * ) Notice: Subject to any disclaimer, the term of this patent is extended or adjusted under 35 U.S.C. 154(b) by 479 days.

(21) Appl. No.: 13/450,465

(22) Filed: Apr. 18, 2012

(65) Prior Publication Data

US 2013/0239306 A1 Sep. 19, 2013

(30) Foreign Application Priority Data

Mar. 19, 2012 (TW) ..... 101204879 U

(51) Int. Cl.
*A61F 9/02* (2006.01)
*A63B 33/00* (2006.01)

(52) U.S. Cl.
CPC ..... *A63B 33/002* (2013.01); *A63B 33/00* (2013.01); *A63B 2033/004* (2013.01); *A63B 2033/006* (2013.01)

(58) Field of Classification Search
CPC ..... A63B 33/002; A63B 2033/004; A63B 33/00; A44B 11/06; A44B 11/065; A61F 9/027; B63C 11/12; G02C 3/003
USPC ..... 2/426, 428, 442–448, 434, 450, 452; 24/593.1, 593.11, 170, DIG. 48, 200; 351/43
See application file for complete search history.

(56) References Cited

U.S. PATENT DOCUMENTS 4,171,555 A * 10/1979 Bakker ..... A44B 11/04 24/200
4,571,783 A * 2/1986 Kasai ..... A44B 11/04 24/169
4,637,099 A * 1/1987 Kasai ..... A44B 11/04 24/169
4,918,753 A * 4/1990 Mermillod ..... 2/10
5,243,741 A * 9/1993 Fudaki ..... A44B 11/04 24/197
5,617,588 A * 4/1997 Canavan et al. ..... 2/428
5,651,166 A * 7/1997 Lundstedt ..... 24/200
6,350,030 B2 * 2/2002 Fujima ..... 351/43
6,691,378 B1 * 2/2004 Chou ..... 24/170
6,845,521 B2 * 1/2005 Takeshi et al. ..... 2/452
6,865,753 B2 * 3/2005 Nishida ..... 2/426
6,961,965 B2 * 11/2005 Chiang ..... 2/445
7,150,079 B2 * 12/2006 Lundstedt ..... F16G 11/10 24/129 R
7,181,780 B1 * 2/2007 Chiang ..... 2/452

(Continued)

FOREIGN PATENT DOCUMENTS

GB 877472 A * 9/1961

*Primary Examiner* — Alissa L Hoey
*Assistant Examiner* — Jameson Collier
(74) *Attorney, Agent, or Firm* — Cheng-Ju Chiang

(57) ABSTRACT

Swimming goggles include a frame body, lenses, buckles attached to left and right portions of the frame body, and a head strap passed through the buckles. Each of the buckles has a base having a connecting portion and a guiding portion, and an operating portion. With the head strap being frictional engaged with the guiding portions and retained by the operating portion and being stretched after wearing of the swimming goggles, the head strap is adjustable through the buckles without taking off the swimming goggles, so as to provide a quick and easy adjustment, and a lower cost of manufacturing because of simplified structure.

5 Claims, 7 Drawing Sheets

(56) References Cited

U.S. PATENT DOCUMENTS

| | | | | |
|---|---|---|---|---|
| 7,856,674 | B2 * | 12/2010 | Chou | 2/452 |
| 2001/0012091 | A1 * | 8/2001 | Fujima | 351/43 |
| 2008/0134417 | A1 * | 6/2008 | Aoyama | 2/431 |
| 2008/0172777 | A1 * | 7/2008 | Chiang | 2/428 |
| 2010/0077539 | A1 * | 4/2010 | Chen | 2/452 |
| 2010/0083426 | A1 * | 4/2010 | Chiang | 2/428 |
| 2011/0056003 | A1 * | 3/2011 | Chen | 2/440 |

* cited by examiner

SWIMMING GOGGLES

BACKGROUND OF THE INVENTION

1. Field of the Invention

The present invention relates to swimming goggles, and particularly to swimming goggles which have easily-adjustable buckles for tightening and loosening a head strap without taking off the swimming goggles.

2. Related Art

Generally, it is necessary to adjust a head strap when wearing swimming goggles. As is well known, the length of a head strap is being adjusted with buckles of frames of swimming goggles. Early buckles are only intended to allow the head strap to pass through. Once the head strap is to be adjusted, it has to be taken off from a wearer first, and then is manually moved backwards and forwards through the buckles in a direction of where it is passed through. Due to the inconvenient adjustment of the head strap, late buckles of swimming goggles are improved to have an engaging structure. The engaging structure has an engaging arm for being engaged with saw-shaped slots of a head strap so as to retain the head strap in place, whereby the head strap is only allowed to be tightened in one direction, without taking off the swimming goggles. To loosen the head strap, the engaging arm is to be disengaged with the saw-shaped slots. As a result, adjustment of the head strap of traditional swimming goggles depends entirely on the engagement and disengagement of the engaging arm and the saw-shaped slots.

Although the head strap of the above-mentioned traditional swimming goggles is adjustable without being taken off, the traditional buckles and head strap are still cumbersome and large in size, and therefore cause a higher cost of manufacturing.

SUMMARY OF THE INVENTION

Accordingly, an object of the present invention is to provide swimming goggles having buckles which are easily and detachably to be assembled, and enable a quick adjustment of a head strap without taking off the swimming goggles, and have simple structures so as to further lower the manufacturing cost.

To achieve the above-mentioned object, swimming goggles of the present invention comprise a frame body, lenses, buckles attached to left and right portions of the frame body, and a head strap passed through the buckles; wherein each of the buckles comprises a base having outer and inner surfaces, a connecting portion, and a guiding portion, the connecting portion connected with the left and right portions of the frame body, the guiding portion forming an opening therein and being provided with a rib dividing the opening into a first guiding hole adjacent to the connecting portion, and a second guiding hole adjacent to the operating portion; and an operating portion provided with a pressing lip formed adjacent to the second guiding hole, the pressing lip extending towards the inner surface of the base and beyond an outer surface of the rib; and wherein the head strap passes through the first guiding hole from the inner surface of the base and around the rib to pass through the second hole and the inner surface again.

With the above-mentioned structure, once the swimming goggles of the present invention is being put on, sides of the strap with respect to the first guiding hole are being pulled and stretched outwards to be attached to the free end portions of the strap with respect to the second guiding hole, wherein the free end portions are frictionally engaged with the pressing lips, and portions of the strap adjacent to the first guiding hole are frictionally engaged with the ribs. Accordingly, the head strap is firmly retained by the frictional engagement with the ribs and the pressing lips, and is therefore not moveable. When the strap is needed to be loosened, just pull the operating portions outwards towards the outer surfaces to release the free end portions engaged by the pressing lips and to lower friction between the strap and the ribs, so as to allow the strap to move automatically within the first and second guiding holes, without being taken off from a wearer. When the strap is to be tightened, just pull the free end portions backwards to a desired length, without being taken off from the wearer

DESCRIPTION OF THE PREFERRED EMBODIMENTS

Figure 1:
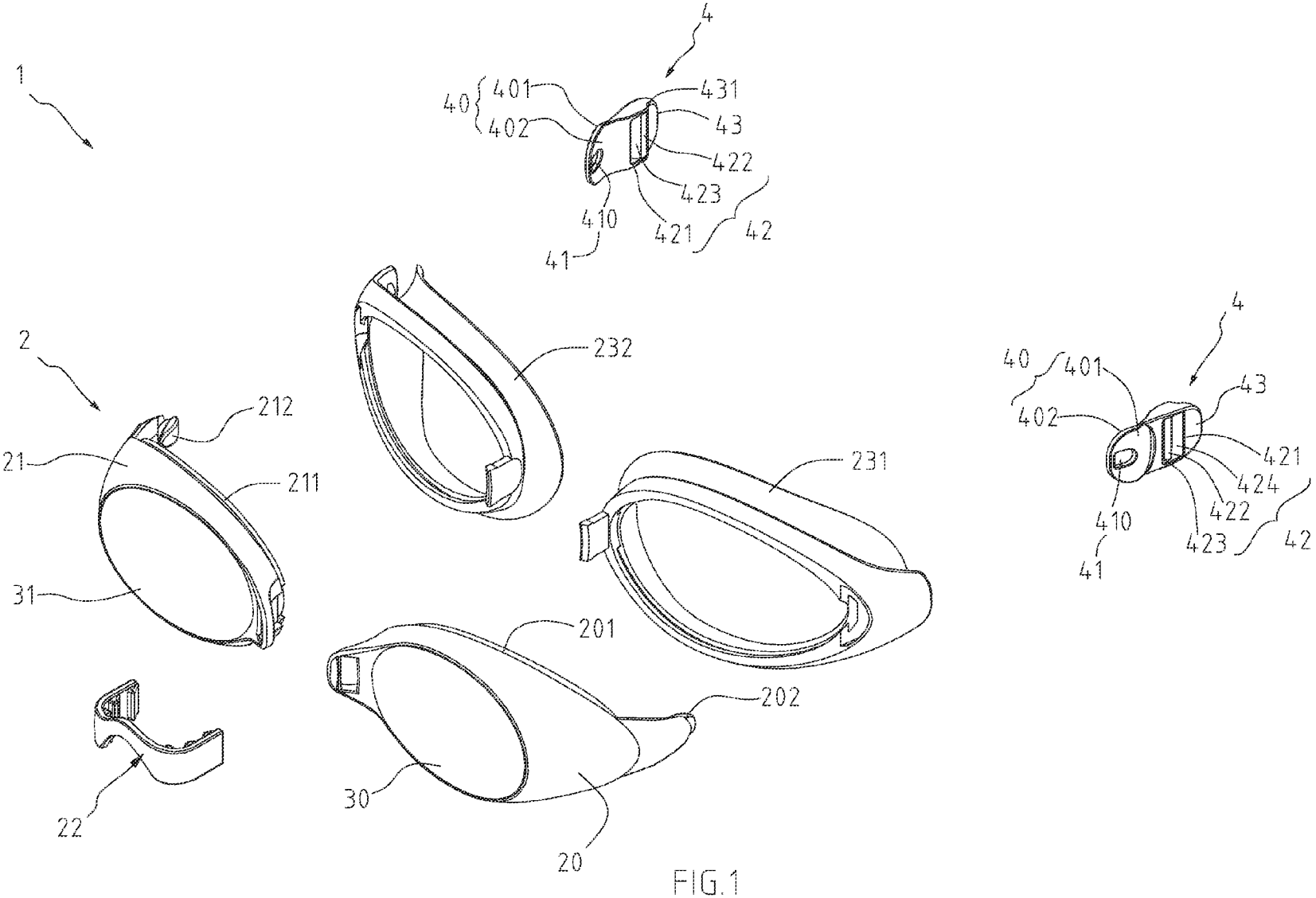
FIG. 1 is an exploded perspective view of swimming goggles of the present invention.
Figure 2:
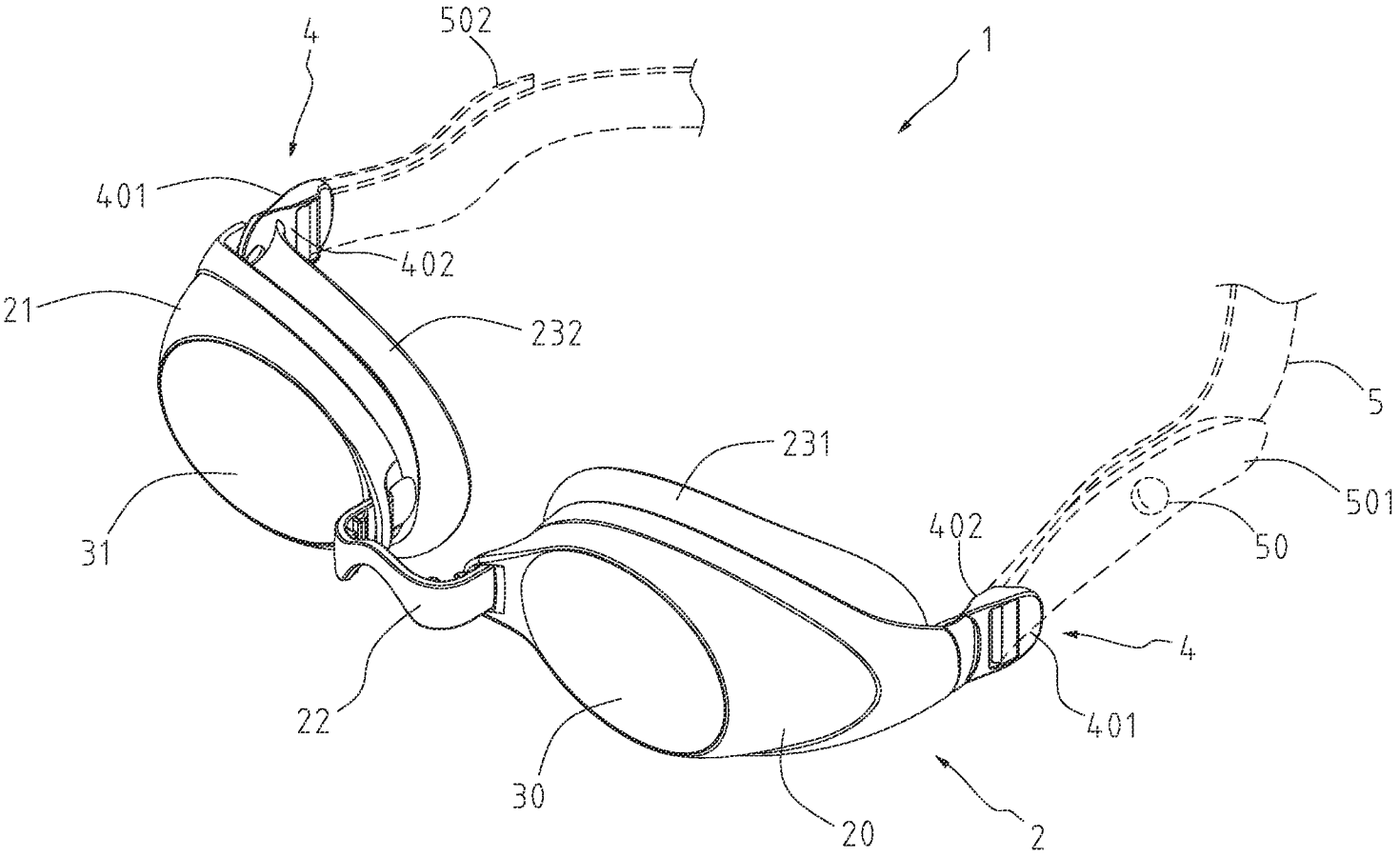
FIG. 2 is a perspective assembly view of FIG. 1.

Referring to FIGS. 1 and 2, swimming goggles 1 of the present invention comprises: a frame body 2, lenses 30, 31, buckles 4 attached to left and right portions of the frame body 2, and a head strap 5 passed through the buckles 4. The frame body 2 comprises left and right frames 20, 21, a nose bridge 22 interconnecting the left and right frames 20, 21, and protective portions 231, 232 attached on the left and right frames 20, 21, respectively. The lenses 30, 31 and the left and right frames 20, 21 are integrally formed and made of Polycarbonate resin (PC), and the left and right frames 20, 21 are formed with lip edges 201, 211. The lip edges 201, 211 are recessed from peripheral portions of the left and right frames 20, 21 opposite to the lenses 30, 31 and are intended to facilitate the formation with the protective portions 231, 232, whereby to allow the peripheral portions of the protective portions 231, 232 to cover and be attached firmly on the lip edges 201, 211. The protective portions 231, 232 are made of thermal plastic rubber (TPR) for protecting a contact area of a wearer's face and providing a comfortable contact when wearing.

Figure 5:
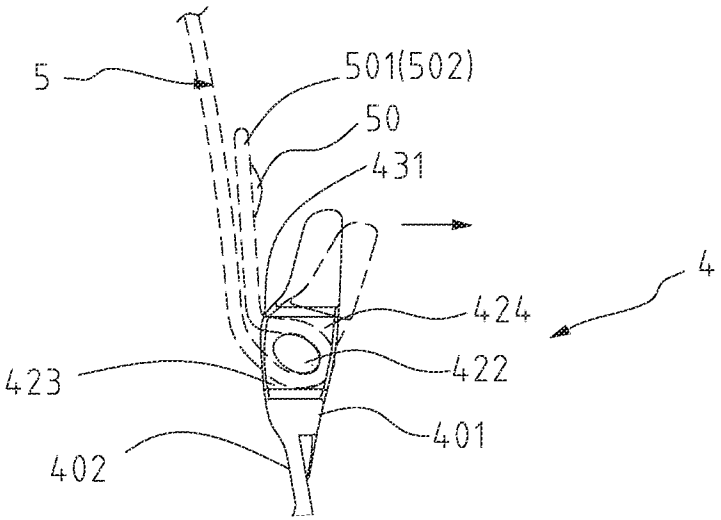
FIG. 5 is a schematic cutaway side view showing a buckle of the swimming goggles.

The buckles 4 are made of thermoplastic polyurethane (TPU), each buckle 4 comprising a base 40 having outer and inner surfaces 401, 402, and an operating portion 43, wherein the base 40 further has a connecting portion 41 and a guiding portion 42. The connecting portion 41 slightly bends inwards and towards the lenses 30, 31 and has a substantially board shape. The connecting portion 41 forms a connecting hole 410 thereon. The left and right frames 20, 21 are provided with hook portions 202, 212 which bend inwards and towards the lenses 30, 31, respectively. The connecting portions 41 are detachably hooked in the hook portion 202, 212 with the connecting holes 410 so as to connect the bases 40 with the left and right frames 20, 21. The guiding portion 42 forms an opening 421 therein and is provided with a rib 422 which divides the opening 421 into a first guiding hole 423 adjacent to the connecting portion 41, and a second guiding hole 424 adjacent to the operating portion 43. The rib 422 has an oval section (as shown in FIG. 5), and a lengthwise axis of the oval second is tilted with respect to the inner surface 402 of the base 40 at an angle of 45 degrees. With the structure of the rib 422, the strap 5 passes through the first guiding hole 423 from the inner surface 402 of the base 40, and then pass around the rib 422 at 45 degrees through the second hole 424 and the inner surface 402 again. Each operating portion 43 is provided with a pressing lip 431 formed on an inner wall of the operating portion 43 with respect to the inner surface 402 of the base 40 and adjacent to the second guiding hole 424. The pressing lip 431 protrudes outward from the inner wall of the operating portion 43 and beyond an outer surface of the rib 422 such that the operating portion 43 increases in thickness.

Particularly, a maximum width of the guiding portion 42 is larger than that of the operating portion 43, the maximum width of the operating portion 43 is larger than that of the connecting portion 41. Because the connecting portion 41 is thinner than the guiding portion 43 and the operating portion 43, and has the substantially board shape, the operating portion 43 is therefore movable with the connecting portion 41 functioned as an axis.

The head strap 5 is made of silicone and has two opposite free end portions 501, 502. Two protruding portions 50 are formed on a side of the head strap 5 and adjacent to the free end portions 501, 502, respectively (as shown in FIG. 2), for preventing the head strap 5 from being pulled out of the second guiding holes 424.

Figure 3:
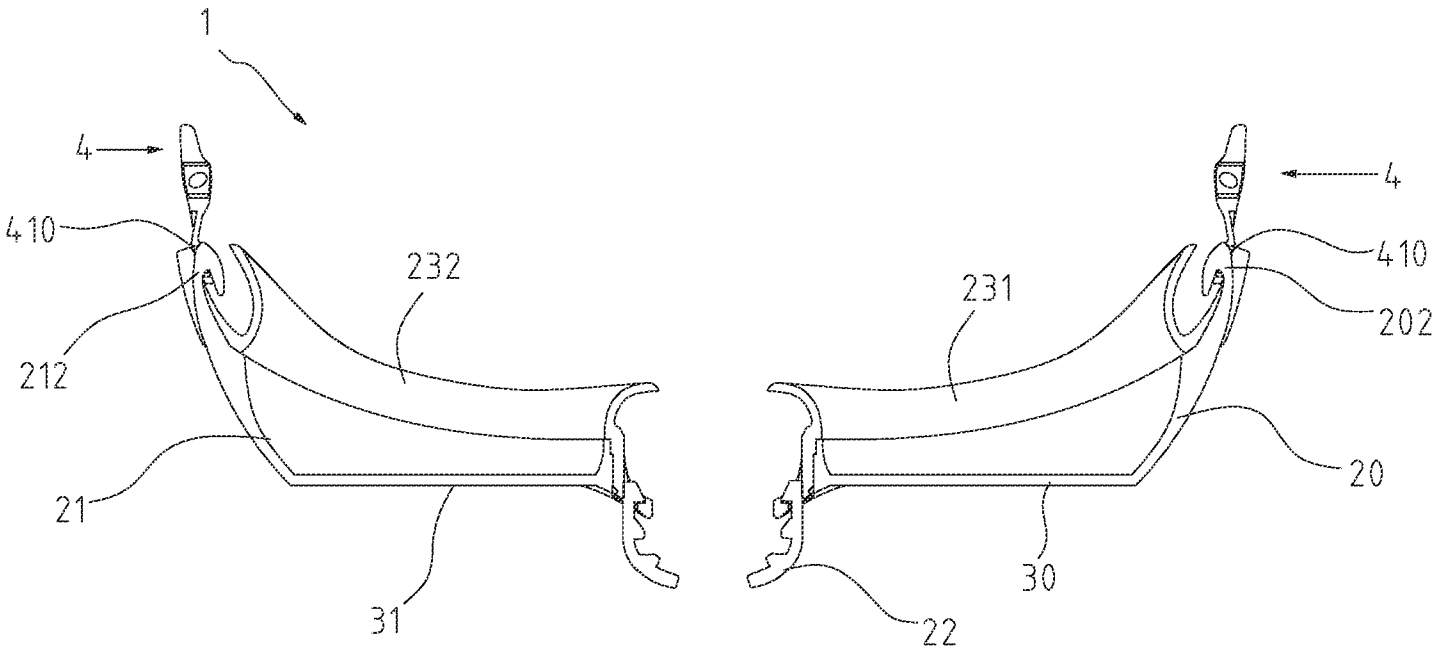
FIG. 3 is a schematic top plan view of the swimming goggles.
Figure 4:
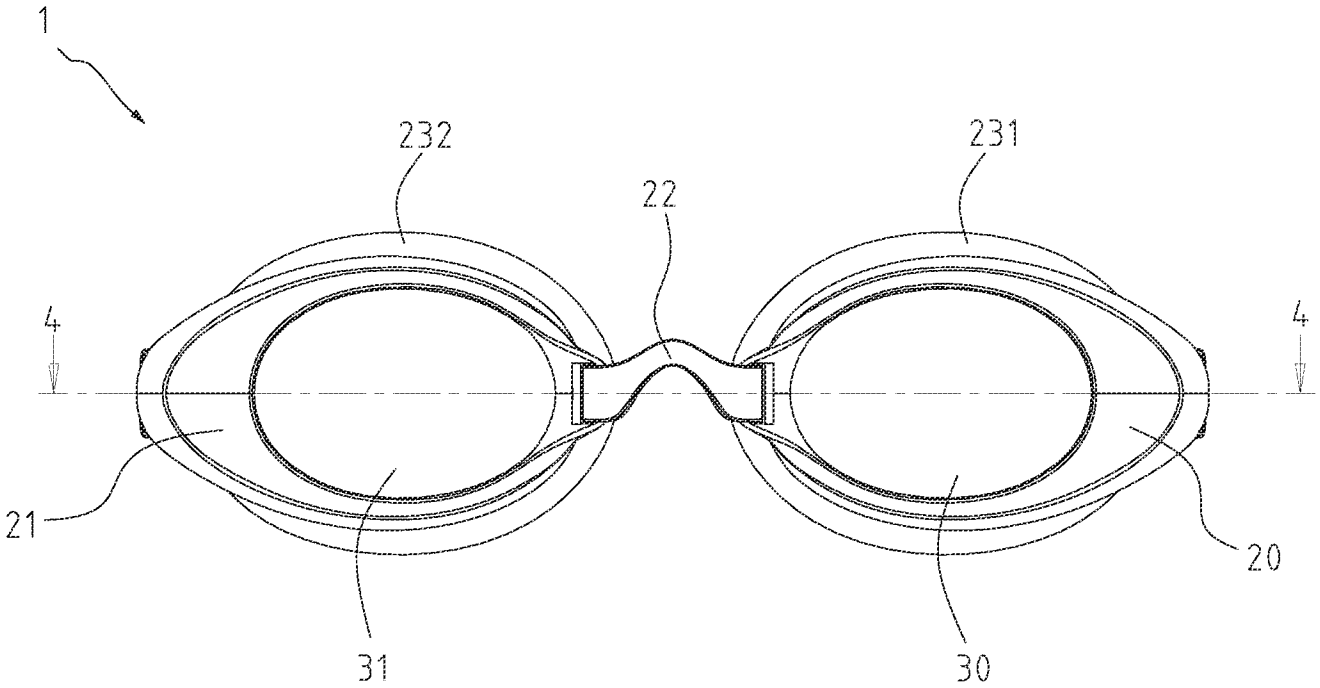
FIG. 4 is a cross-sectional view taken along the line 4-4 in FIG. 3.

Referring to FIG. 1 in combination with FIGS. 2 to 4, prior to assembly of the swimming goggles 1, the left and right frames 20, 21 and the lenses 30, 31 are integrally formed with the protective portions 231, 232. As a result, the nose bridge 22 is only needed to be assembled with the left and right frames 20, 21. And the buckles 4 are detachably hooked in the hook portion 202, 212 with the connecting hole 410 so as to connect the bases 40 and the left and right frames 20, 21. The buckles 4 are easily and quickly removable from the hook portion 202, 212 for the purpose of repair, replace, or storage in a container.

Figure 6:
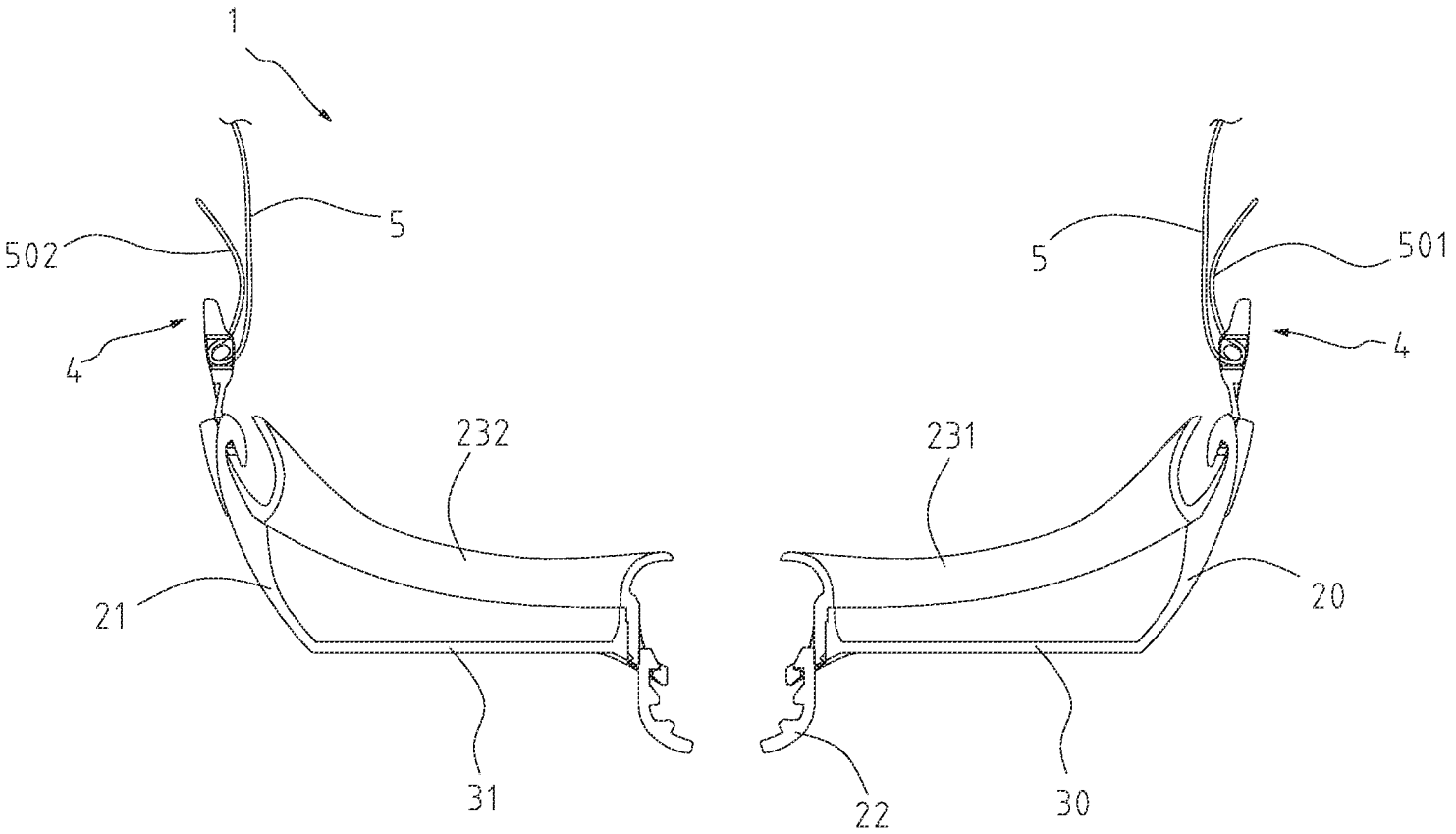
FIG. 6 is a schematic view showing a head strap is being fastened with the buckles of the present invention.
Figure 7:
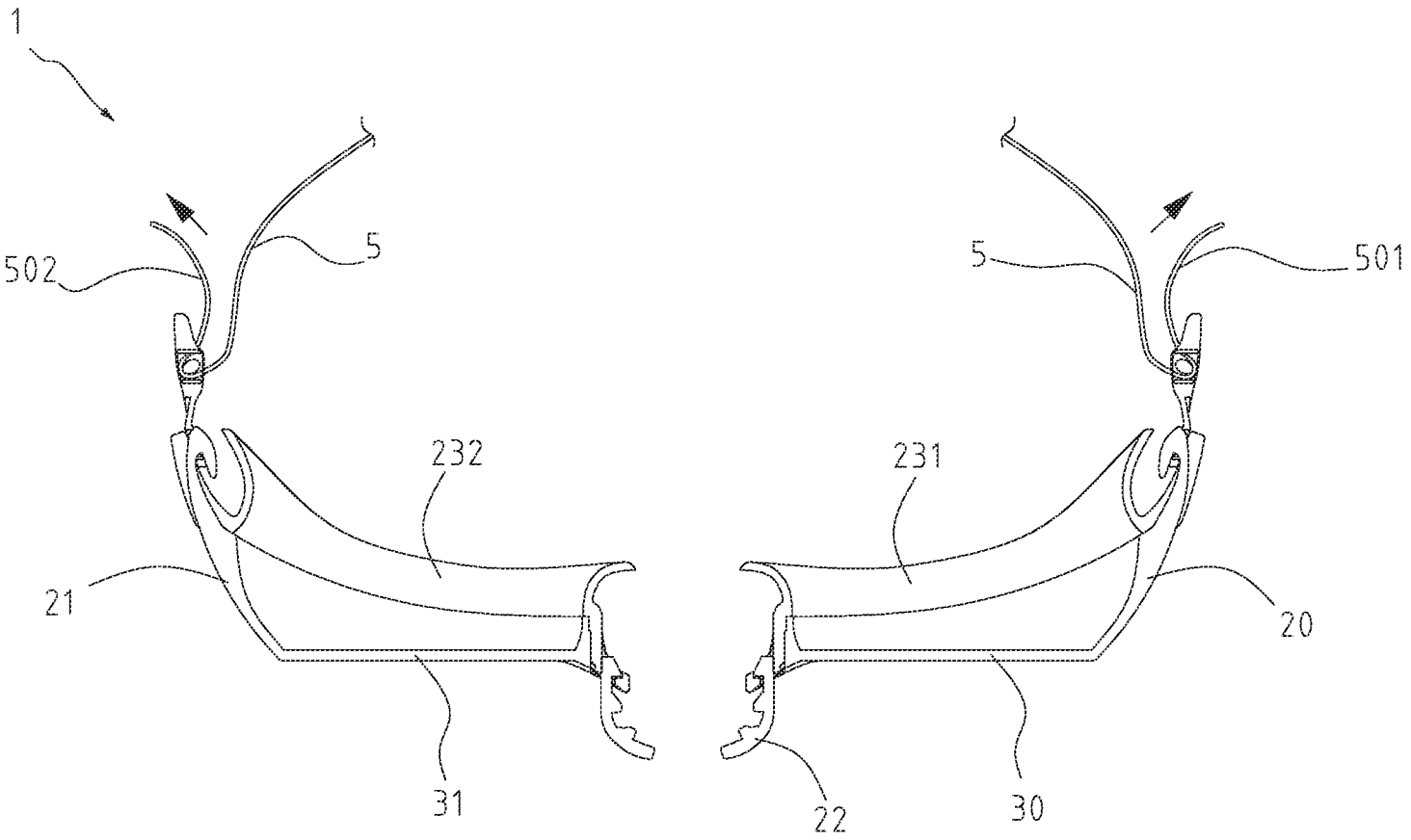
FIG. 7 is a schematic view showing the buckles are being pushed outwards to release the heat strap.

Referring to FIGS. 5 and 6, once the swimming goggles 1 of the present invention is being put on, sides of the strap 5 with respect to the first guiding hole 423 are being pulled and stretched outwards to be attached to the free end portions 501, 502 of the strap 5 with respect to the second guiding hole 424, wherein the free end portions 501, 502 are frictionally engaged with the pressing lips 431, and portions of the strap 5 adjacent to the first guiding hole 423 are frictionally engaged with the ribs 422, and wherein each of the respective free end portions 501, 502 passing through the respective first and second guiding holes 423, 424 bends back onto the head strap 5 at the respective pressing lip 431 as a bending point of which a bending angle is changeable by moving the respective operating portion 43 in a direction from the inner surface 402 to the outer surface 401 of the respective base 40 so as to reduce a friction force arisen from the respective bending point and allow adjustment of the head strap 5, and wherein the respective free end portion 501, 502 is frictionally sandwiched between the head strap 5 and the respective operating portion 43 at the respective bending point when the respective operating portion 43 is not being moved in the direction from the inner surface 402 to the outer surface 401 of the respective base 40. Accordingly, the head strap 5 is firmly retained by the frictional engagement with the ribs 422 and the pressing lips 431, and is therefore not moveable (as shown in FIG. 5). When the strap 5 is needed to be loosened, just pull the operating portions 43 outwards towards the outer surfaces 401 (as an arrow direction shown in FIG. 5) to release the free end portions 501, 502 engaged by the pressing lips 431 and to lower friction between the strap 5 and the ribs 422, so as to allow the strap 5 to move automatically within the first and second guiding holes 423, 424 (as shown in FIG. 7), without being taken off from the wearer. When the strap 5 is to be tightened, just pull the free end portions 501, 502 backwards to a desired length, without being taken off from the wearer.

It is understood that the invention may be embodied in other forms within the scope of the claims. Thus the present examples and embodiments are to be considered in all respects as illustrative, and not restrictive, of the invention defined by the claims.

What is claimed is:

1. Swimming goggles, comprising: a frame body having left and right frames, lenses, two buckles each attached to the left and right frames, respectively, and a head strap passed through the buckles; wherein each of the buckles comprises:

a base having outer and inner surfaces, a connecting portion, and a guiding portion, the respective connecting portions being connected with each of the left and right frames, respectively, the guiding portion forming an opening therein and being provided with a rib dividing the opening into a first guiding hole and a second guiding hole, the head strap having two opposite free end portions, each of the respective free end portions passing through the respective first guiding hole from the inner surface of the respective base to be tightened around the respective rib, and passing through the respective second guiding hole back to the inner surface again; and an operating portion located on a side of the respective guiding portion opposite to the respective connecting portion and provided with a pressing lip which is protruded from an inner wall of the respective operating portion with respect to the inner surface of the respective base, wherein each of the respective free end portions passing through the respective first and second guiding holes bends back onto the head strap at the respective pressing lip as a bending point of which a bending angle is changeable by moving the respective operating portion in a direction from the inner surface to the outer surface of the respective base so as to reduce a friction force arisen from the respective bending point and allow adjustment of the head strap, and wherein the respective free end portion is frictionally sandwiched between the head strap and the respective operating portion at the respective bending point when the respective operating portion is not being moved in the direction from the inner surface to the outer surface of the respective base;

wherein the rib has an oval cross-section, and a lengthwise axis of the oval cross-section is tilted with respect to the inner surface of the base and the lengthwise axis of the oval cross-section of the rib is tilted with respect to the inner surface of the base at an angle of 45 degrees;

wherein a maximum width of the guiding portion is larger than a maximum width of the operating portion, the maximum width of the operating portion is larger than a maximum width of the connecting portion;

wherein the connecting portion is formed with a connecting hole thereon, each of the left and right frames is provided with a hook portion, and the connecting portion is detachably hooked in the hook portion with the connecting hole.

2. The swimming goggles of claim 1, wherein a nose bridge interconnects the left and right frames, and protective portions are attached on the left and right frames, respectively.

3. The swimming goggles of claim 2, wherein the lenses and the left and right frames are integrally formed and made of polycarbonate resin (PC), lip edges are formed on peripheral portions of the left and right frames opposite to the lenses, respectively, and the protective portions are made of thermoplastic rubber (TPR) and cover the lip edges.

4. The swimming goggles of claim 1, wherein the head strap is made of silicone, and a protruding portion is formed on the free end portion after the free end portion passes through the second guiding hole back to the inner surface so as to prevent the free end portion from slipping into the second guiding hole again.

5. The swimming goggles of claim 1, wherein the buckles are made of thermoplastic polyurethane (TPU).

* * * * *